United States Patent [19]

Vadas

[11] 4,312,171

[45] Jan. 26, 1982

[54] METHOD AND APPARATUS FOR PURGING AIR FROM CONTAINERS

[75] Inventor: Leslie Vadas, Los Gatos, Calif.

[73] Assignee: FMC Corporation, Chicago, Ill.

[21] Appl. No.: 110,652

[22] Filed: Jan. 24, 1980

[51] Int. Cl.[3] ..... B65B 31/02

[52] U.S. Cl. ..... 53/403; 53/432; 53/79; 53/510

[58] Field of Search ..... 53/79, 403, 407, 432, 53/434, 86, 510; 426/316

[56] References Cited

U.S. PATENT DOCUMENTS

| | | | |
|---|---|---|---|
| 2,107,237 | 2/1938 | Davies | 53/407 |
| 2,240,655 | 5/1941 | Kronquest | 226/68 |
| 2,285,867 | 6/1942 | Minaker | 226/82 |
| 2,317,470 | 4/1943 | Marx | 99/182 |
| 2,330,598 | 9/1943 | Kronquest | 226/68 |
| 2,623,672 | 12/1952 | O'Neil | 53/403 |
| 3,157,011 | 11/1964 | Wheatley | 53/22 |
| 3,619,975 | 11/1971 | Johnson et al. | 53/112 B |
| 3,871,157 | 3/1975 | Domke et al. | 53/110 |
| 4,016,705 | 4/1977 | Wilson et al. | 53/407 |
| 4,081,942 | 4/1978 | Johnson | 53/407 |

*Primary Examiner*—Robert D. Baldwin

*Attorney, Agent, or Firm*—A. J. Moore; R. B. Megley

[57] ABSTRACT

A method and apparatus is disclosed for purging air from containers, such as pouches, while in the ambient atmosphere, which apparatus uses a continuous flow of a neutral purging gas at a pressure between a range of about 1"-2" of water that is directed into the open end of the container through a flow control valve having a flat surface overlapping the open end of the container and disposed substantially parallel to and within about ⅛th inch from the open end of the container.

14 Claims, 6 Drawing Figures

| TEST NO.'S | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|
| PURGING SYSTEMS AND TEST CONDITIONS | | | | | | | | | | | | | | | | | | | | | | | |
| VALVE TYPE - PLATE | X | X | X | | | | X | X | X | X | X | X | X | X | X | X | X | X | X | | | | |
| VALVE TYPE - CYLINDER | | | | X | X | X | | | | | | | | | | | | | | | | | |
| VALVE TYPE - TUBE | | | | | | | | | | | | | | | | | | | | X | X | X | X |
| SETTING ABOVE POUCH 1/8" | | | | | | | X | | | X | | | X | | | | | | | X | | | |
| SETTING ABOVE POUCH 1/4" | X | X | X | X | X | X | | X | | | X | | | X | | | X | X | | | X | | |
| SETTING ABOVE POUCH 3/8" | | | | | | | | | X | | | X | | | X | | | | X | | | X | |
| STEAM PRESSURES IN INCHES OF WATER 0.5" | | | | | | | | | | | | | | | | X | X | | | | | | |
| STEAM PRESSURES IN INCHES OF WATER 1.0" | X | X | X | X | X | X | X | X | X | X | X | X | X | X | X | | | | | X | X | X | X |
| STEAM PRESSURES IN INCHES OF WATER 2.0" | | | | | | | | | | | | | | | | | | X | X | | | | |
| PRODUCT FILL TEMPERATURE °F 80°F | X | | | X | | | | | | | | | | | | | | | | | | | |
| PRODUCT FILL TEMPERATURE °F 120°F | | X | | | X | | X | X | X | X | X | X | X | X | X | X | X | X | X | X | X | X | X |
| PRODUCT FILL TEMPERATURE °F 180°F | | | X | | | X | | | | | | | | | | | | | | | | | |
| AVERAGE AMOUNT OF AIR REMAINING IN POUCH AFTER PURGING AND SEALING $CM^3$ | 0.52 | 0.645 | 0.305 | 0.835 | 0.685 | 0.800 | 0.410 | 0.645 | 1.860 | 0.340 | 0.665 | 1.885 | 0.260 | 0.650 | 1.325 | 1.225 | 1.680 | 1.870 | 1.865 | 1.995 | 3.700 | 4.235 | 5.875 |
| STANDARD DIVIATION OF RETAINED AIR FROM AVERAGE OF 20 POUCHES $CM^3$ | .018 | 0.185 | 0.179 | 0.230 | 0.163 | 0.250 | 0.165 | 0.185 | 0.336 | 0.167 | 0.216 | 0.425 | 0.114 | 0.234 | 0.271 | 0.401 | 0.382 | 0.944 | 0.554 | 0.56 | 0.47 | 0.86 | 1.20 |
| | ALL POUCHES 6 1/2"x8 1/2"- ALL POUCHES FILLED WITH 400 GRAMS OF WATER | | | | | | | | | | | | | | | | | | | | | | |

FIG_6

METHOD AND APPARATUS FOR PURGING AIR FROM CONTAINERS

BACKGROUND OF THE INVENTION

1. Field of the Invention

The present invention pertains to processing products in filled containers, and more particularly relates to a method and apparatus for purging air from containers such as pouches prior to closing and sealing the same.

2. Description of the Prior Art

It is well known that it is essential for air to be purged from containers filled with a food or other easily oxidized products prior to sealing the containers in order to minimize oxidation of the product and thus provide a high quality pack. Prior art methods and apparatus for purging air from containers by flushing with neutral gases, vacuum, high pressure steam, or low pressure steam within steam tunnels are well known in the art. Many known prior art purging systems require costly apparatus such as steam tunnels, or require equipment to move snorkel tubes into and out of the containers. The operating costs of these and other purging systems are high because they require excessive amounts of neutral gases such as carbon dioxide, or steam at high pressure and/or at superheated temperatures for purging the air from the containers. Many of these prior art systems are also too complicated and/or do not efficiently remove air from the pouch.

Assignee's prior art United States patent to Wilson et al which issued as U.S. Pat. No. 4,016,705 on Apr. 12, 1977 discloses two prior art systems for purging air from filled pouches. Both of these purging systems require the open upper end of the pouch to pass through a steam atmosphere in a steam tunnel. One of the systems requires that a steam nozzle be reciprocated into and out of the pouch during purging and that a high pressure jet of steam be directed into the pouch through the nozzle while steam at a lower pressure flows downwardly past the outer walls of the pouch to remove air from the pouch. The other Wilson et al system directs steam into the headspace of the pouch between spaced baffle plates that are secured to the walls of the tunnel for directing the downward flow of steam into the headspace and to prevent a direct flow of steam downwardly between the tunnel walls and the external surfaces of the pouch for providing an avenue for the purged air to escape.

United States Johnson U.S. Pat. No. 4,081,942 which issued on Apr. 4, 1978 discloses an intermittently driven machine for filling two types of products into a pouch, and purging air from the filled pouch while the pouch is in the ambient atmosphere at a steaming station by means of a continuous flow of steam at approximately 450° F. into the open end of the pouch from a nozzle located just above the open end of the pouch.

Other United States patents such as Davis U.S. Pat. No. 2,107,237; Kronquest U.S. Pat. No. 2,240,655; Minaker U.S. Pat. No. 2,285,867 and Marx U.S. Pat. No. 2,317,470 move containers through steam tunnels for purging air from the containers.

SUMMARY OF THE INVENTION

In accordance with the present invention a simple, low cost, and highly efficient method and apparatus has been developed for purging air from the headspaces of containers while the containers are in the ambient atmosphere at a purging station. A neutral air purging gas, preferably saturated steam, is continuously directed at a low pressure and relative high volume through a relatively large aperture in a plate type flow control valve having a planar flow control surface that encompasses and is substantially parallel to the open end of the container being purged.

When a batch of containers of the same size are to be processed, the flow control surface of the flow control valve is set at a predetermined distance above the plane of the open ends of the filled containers to provide an unobstructed balanced flow path of the steam-air mixture guided out of the headspace between the periphery of the open end of each container and the flow control surface which provides a gentle non-turbulent flow thus precluding backflow of ambient air into the container.

In accordance with the present invention, a flow control apparatus for purging air from a filled container when one end of the container is open is provided, said device comprising a flow control valve having an apertured flat flow control surface positioned adjacent said open end of the container overlaping the opening of the container to encompass the open end while spaced about $\frac{1}{8}$th of an inch therefrom, means for directing a neutral air purging gas at a pressure of between about 1–2 inches of water through said aperture into the open end of the container for creating a gentle non-turbulent flow of air and other gases out of the container along an unobstructed balanced flow path defined between the periphery of said open end of the container and said flat flow control surface.

Further in accordance with the present invention a method of purging air from containers using an apertured flat flow control valve having a flat flow control surface disposed substantially parallel to the peripheral edge of the open end of a container to be purged is provided, said method comprising the steps of establishing relative movement between the container and the flow control valve for positioning said flat flow control surface in a position encompassing the open end of the container and closely adjacent to the open end of the container, directing a neutral air purging gas at a low pressure through the apparatus into the open end of the container for creating a gentle substantially non-turbulent flow of air and other gases out of the pouch along an unobstructed balanced flow path defined between the periphery of said open end of the container and said flat flow controlling surface.

BRIEF DESCRIPTION OF THE DRAWINGS

FIG. 6 is a chart indicating the results of several air purging tests performed on the pouches.

DESCRIPTION OF THE PREFERRED EMBODIMENT

Figure 1:
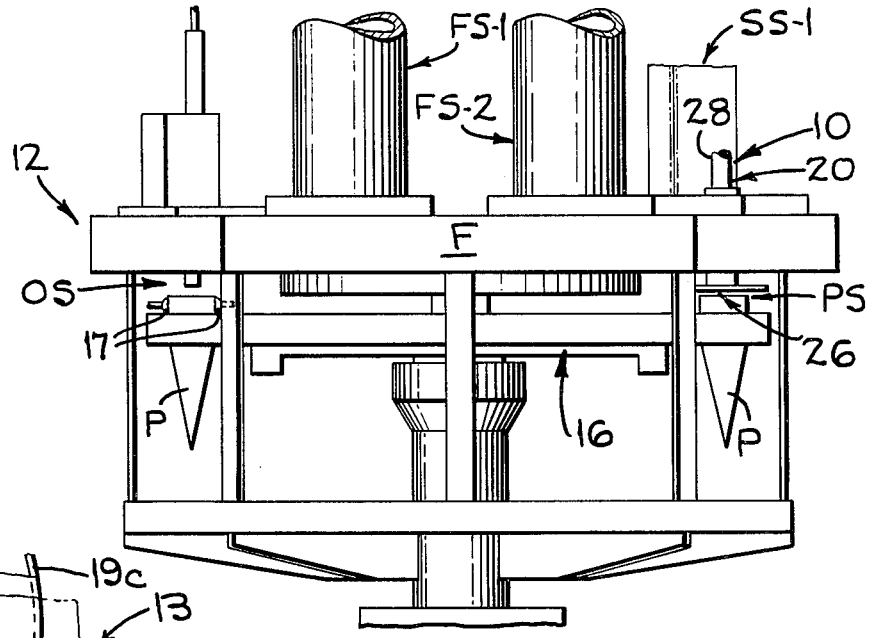
FIG. 1 is a diagrammatic side elevation of a turret type pouch filling, purging and sealing machine in which the air purging apparatus of the present invention is employed.
Figure 2:
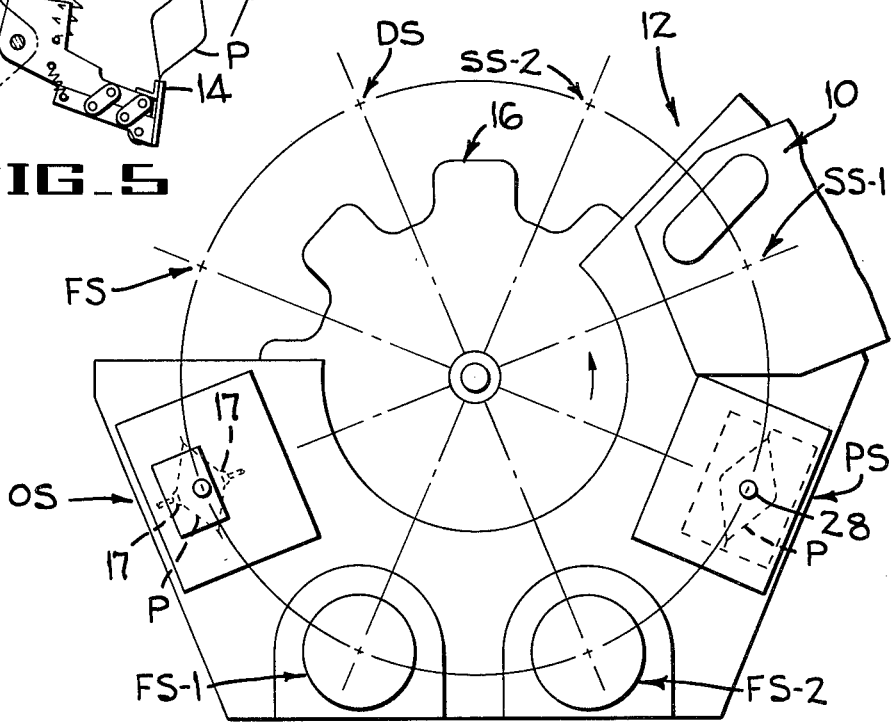
FIG. 2 is a diagrammatic plan of the machine of FIG. 1 illustrating the location of the purging station relative to the other components of the machine.

The air purging apparatus 10 (FIGS. 3 and 4) of the present invention is preferably used at a purging station PS of a well known turret type pouch filling, purging and sealing machine 12 as diagrammatically illustrated in FIGS. 1 and 2.

Figure 5:
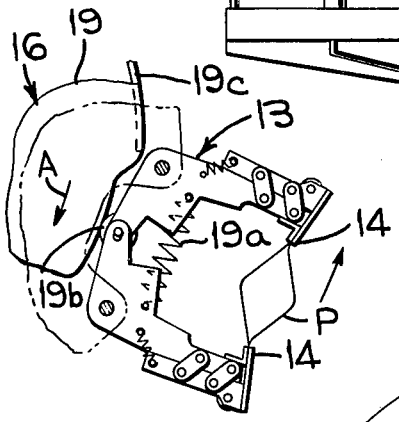
FIG. 5 is an enlarged plan view of a pair of pouch grippers with an open pouch therein, said view illustrating the structure for closing the pouch prior to being indexed out of the purging station.
Figure 3:
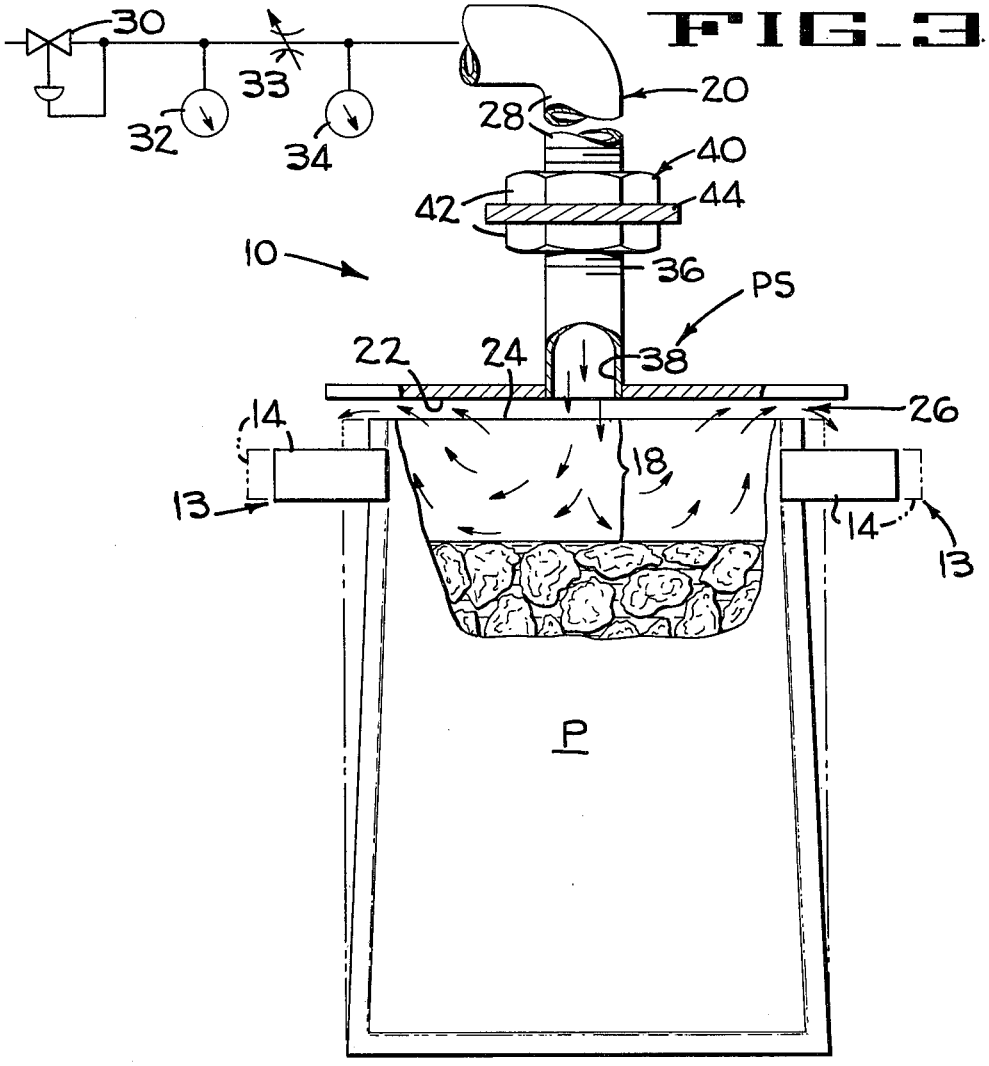
FIG. 3 is a diagrammatic vertical central section of a filled pouch in the purging station of the pouch filler of FIG. 1 with the plate type flow control valve positioned above the open end of the pouch, said view further illustrating the means for maintaining the neutral air purging gas at a low pressure and the non-turbulent balanced flow path of gases purged from the container.
Figure 4:
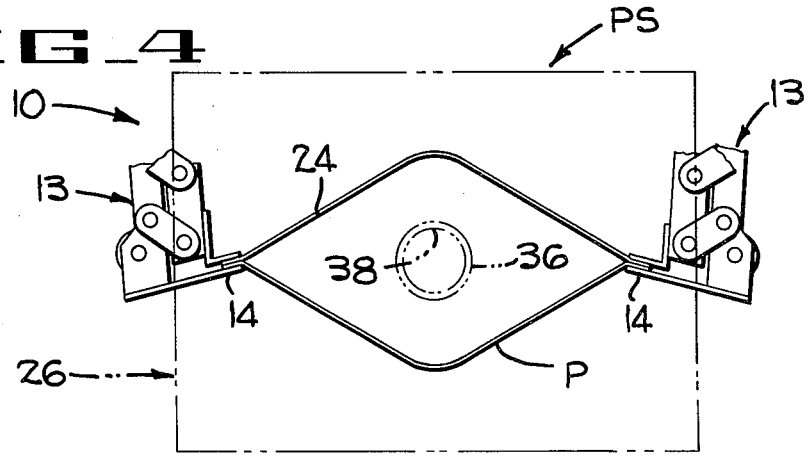
FIG. 4 is a diagrammatic plan of a pouch in the purging station with the flow control valve illustrated in phantom lines above the pouch.

In general, the machine 12 preferably includes a feed station FS where flat pouches are transferred from a magazine and are supported by one of several pouch supporting mechanisms 13 which include a pair of grippers 14 (FIGS. 3, 4 and 5). The pouch supporting mechanisms 13 are mounted on an intermittently driven turret 16 that advances each pouch P to a pouch opening station OS. When dwelling at the opening station, a pair of suction cups 17 grip the sides of the pouch adjacent the open upper edges thereof thereby opening the upper end of the pouch while the grippers are actuated to move inwardly towards each other as illustrated in FIG. 3. While at the pouch opening station OS, the opening operation may be assisted by directing a jet of steam or air into the pouch. The open pouch is then indexed into a first filling station FS-1 and thereafter into a second filling station FS-2 where one or two different types of products could be discharged into the pouch. For example, the products may be meat and a sauce with the upper surface of the product being substantially at the level indicated in FIG. 3, and with a pouch headspace 18 being defined above the product level.

After the pouch has been filled, it is advanced to the air purging station PS where air is purged from the headspace and/or from within the product if a particulate product is being packaged. At the completion of the purging cycle and while at the purging station the upper end of the pouch is closed by moving the grippers 14 away from each other in a manner well known in the art. For example, an oscillating cam 19 (FIG. 5) is actuated by the machine 12 to oscillate about the axis of the turret 16 in the direction of arrow A pivoting the grippers 14 outwardly against the urging of spring 19*a* in response to moving the large diameter portion of oscillating cam 19 against the roller 19*b*. After moving out of the purging station the roller 19*b* rides along a stationary cam track 19*c* to apply a pouch closing tension to the pouch walls until it has been sealed. The air purging apparatus 10 and its method of operation will be described in detail below.

The filled, purged, and closed pouch is then advanced to a first sealing station SS-1 and thereafter to a second sealing station SS-2 where the upper end of the pouch is heat sealed by the clamping action of electrically heated sealing bars at each sealing station. The sealed pouch is then indexed into a discharge station DS where the seals may be cooled, if necessary, by applying pressure thereto with a pair of cooling bars; and thereafter the pouch is released from the grippers upon a take-away conveyor for removal of the hermetically sealed pouch from the machine.

The illustrated machine 12 is an intermittently driven, 30 pouch per minute machine with the cycle time of the machine being 2 seconds per cycle with ⅔rds of a second being used to index the pouch P from station to station. While purging air from the pouch, each pouch receives saturated steam in its open headspace for one second and the additional ⅓rd of a second is used to close the pouch before moving the pouch out of the purging station.

All of the above operations except the purging operation of the present invention, are well known in the art and have been set forth herein merely to define in general terms the operations necessary to package food or other types of products in hermetically sealed pouches P.

If a more detailed description is desired for a fuller understanding of the several components (not illustrated) at the several stations, reference may be had to assignee's aforementioned Wilson et al U.S. Pat. No. 4,016,705 which describes the components in an inline, rather than a turret type of machine. The disclosure of the Wilson patent is incorporated by reference herein.

The air purging method and apparatus 10 (FIGS. 3 and 4) of the present invention is positioned at the purging station PS, and is preferably placed in the ambient atmosphere at that station without the use of any baffles or steam tunnels.

The air purging apparatus 10 (FIGS. 3 and 4) is quite simple and includes a flow control device 20 that is provided with a flat flow control surface 22 that is substantially parallel to the upper peripheral edge 24 of the open end of the pouch P during purging. The flat or planar surface 22 overlaps the pouch opening and is spaced a short distance from the open end of the pouch and cooperates with the peripheral edge 24 of the pouch to define a flow control valve 26 which is adjusted toward or away from the open end to provide a gentle non-turbulent flow of gases evenly rolling out of the pouch edges thereby minimizing any tendency for air to enter the pouch during the purging operation.

As best shown in FIG. 3, a neutral air purging gas, preferably saturated steam, is directed into a conduit system 28 that preferably includes a pressure reducing valve 30 that reduces the steam to a low pressure as indicated by pressure gauge 32. Since the purging pressure of the steam entering the pouches is within the very low range of between about 1–2 inches of water, and since the pressure reducing valve 30 is relatively unstable at low pressures, the steam is preferably lowered to the above range in two steps. The pressure reducing valve 30 reduces the pressure to about 3 psi, and a needle valve or orifice 33 further reduces the steam pressure to a desired pressure within the range of about 1–2 inches of water as indicated by a second pressure gauge 34. In order to provide a steady, low pressure, relatively high volume flow of steam into the pouch and to provide a substantially non-turbulent stable temperature flow of steam-air out of the pouch through the flow control valve 26, the steam flows continuously through the conduit system 28 and flow control valve when the pouch is dwelling at the purging station and also when the pouch is being indexed from station to station. The continuous flow of steam not only avoids changes in flow velocity due to a start and stop action, reduces the formation of condensate caused by temperature changes resulting from interruptions in steam flow, and also keeps the semi-open purging station lightly saturated with steam.

The low pressure, continuous flowing steam enters the pouch through a tube 36 and a port 38 which is located centrally of the plate type flow control valve 26, which valve includes the upper edge of the pouch as best shown in FIG. 4 and as will be described hereinafter. The gentle flow of low pressure steam enters the headspace 18 (and/or the body of the pouch if the product has voids between particles), and causes air within the pouch which gradually mixes in increasing proportions with the steam to flow outwardly of the pouch between the flat surface 22 and the peripheral edges 24 of the open end of the pouch through a balanced, non-turbulent flow path as indicated in FIG. 3.

In order to adjust the clearance between the peripheral edge 24 of the open end of the pouch P and the flat surface 22 of the valve 26, any suitable adjusting mechanism 40 may be used to raise or lower the planar surface 22. As indicated in FIG. 3, the adjusting mechanism is merely a pair of locknuts 42 threaded on the tube 36 and disposed on opposite sides of the bracket 44 that is secured to the stationary frame F of the machine. The preferred clearance or depth of the balanced flow path is about $\frac{1}{8}$th of an inch.

The above described purging method and apparatus 10 has been extensively tested with a turret type machine 12 as diagrammatically illustrated in the drawings.

During the tests, two pouch sizes were used, a $6\frac{1}{2}$ inch$\times 8\frac{1}{2}$ inch pouch size and a $5\frac{1}{2}$ inch$\times 7\frac{1}{2}$ inch pouch size. However, since the results of the smaller pouches were consistent with the results of the larger pouches, only the results of the larger pouches will be mentioned below.

All of the large pouches were filled with 400 grams of water before testing. The tests were conducted with the flat plate type purging device 10 of the present invention with the flat surface 22 being 3 inches$\times$5 inches for most tests, and the steam port was a $\frac{7}{8}$th inch diameter port. Also, certain tests were conducted with a 2 inch diameter cylindrical purging apparatus having a $\frac{7}{8}$th inch diameter steam port and having outer edges chamfered 30° upwardly starting from a $1\frac{1}{4}$ inch diameter circle (concentric with the port) on the bottom flat face of the cylindrical purging apparatus (not shown). Also included in the test was a 1 inch diameter tube type purging apparatus defining a $\frac{7}{8}$th inch inside diameter discharge port.

Each test was conducted with 20 separate pouches and the average cubic centimeters of air remaining in the pouch, and the standard deviation from the average retained air were computed after the pouches had been purged and sealed.

The various conditions of 23 separate tests are set forth in FIG. 5. The check marks under each test indicate what conditions were observed in that test. For example, in test numbers 1, 2 and 3, it will be noted that the plate type valve of the present invention was used, the lower flat surface was positioned $\frac{1}{4}$ inch above the open end of the pouch, steam at a pressure of 1 inch of water was used as the purging medium, and the variable in these three tests was the temperature of the product in the pouch. The best result of these three tests was obtained in Test No. 3 where the product was at 180° F. and the average non-purged headspace air was 0.305 cubic centimeters.

Test Nos. 4, 5 and 6 were the same as tests 1, 2 and 3, respectively, but were made when using the cylindrical type nozzle or valve as described above rather than the plate type flow control valve 10 of the present invention. The results indicate that the use of the plate type valve 10 was considerably superior to the use of the cylindrical type nozzle.

Tests Nos. 7, 8 and 9 were conducted with a plate type valve while enclosed within a steam tunnel at the purging station, and with the settings or distances between the flat surface 22 of the valve and the top of the pouch being the variable. Test numbers 10, 11 and 12 are the same as test numbers 7, 8 and 9, respectively, except that the plate type valve was not enclosed but was open to the atmosphere to permit unobstructed flow of purged gases from the pouch. It will be noted that the test results were achieved when the valve is about $\frac{1}{8}$th inch away from the open end of the pouch, and that placing the valve in the open atmosphere at the purging station resulted in an average of only 0.340 cubic centimeters of air in the pouch after sealing.

Test numbers 13, 14 and 15 were the same as test numbers 7, 8 and 9 except that a 5 inch$\times$7 inch plate was substituted for the original 3 inch$\times$5 inch plate. It will be noted that the use of the larger plate with a $\frac{1}{8}$th inch setting, again improve the results even though the tests were conducted within a tunnel. This test (No. 13) provided an average of only 0.260 cubic centimeters of air in the pouch, and the standard deviation was a very low 0.114.

Test numbers 16, 17, 18 and 19 were conducted to indicate the effect of varying both the setting and the steam pressure. These tests indicate that a steam pressure of 0.5 inches of water is too low to provide desirable results. They also indicate that a steam pressure of 2 inches of water operates more efficiently when the setting is $\frac{3}{8}$th of an inch as compared to a $\frac{1}{4}$ inch setting. These tests further indicate that there is a correlation between pressures and settings and that the higher pressures require larger settings, while the lower pressures require smaller settings to provide substantially non-turbulent flow of gases out of the pouch through the balanced flow path.

Tests Nos. 20, 21, 22 and 23 were conducted to compare the results obtained with a 1 inch tube having a $\frac{7}{8}$ inch inside diameter as the nozzle with the results obtained by the plate type flow control valve 26 of the present invention. The setting of the tube type valve in Test No. 23 was a variable setting in that the valve was vertically reciprocated during purging. In test No. 23, the bottom of the tube was reciprocated between $\frac{3}{8}$th of an inch above the pouch, to $\frac{1}{2}$ inch within the the pouch. As indicated, the results were quite poor using the tube type nozzle.

The significance and efficiency of the above tests will be appreciated when it is realized that the permissible standard headspace air retained in sealed $6\frac{1}{2}\times 8\frac{1}{2}$ inch pouches is 10 cubic centimeters. Since the results obtained from Test No. 13 indicates that the average headspace air remaining in the pouch was a mere 0.260 cubic centimeters of air, it will be appreciated that the method and apparatus of the present invention greatly advances the art.

The above tests indicate that best and most consistent purging of air from the pouches occurred when the flow control plate type valve of the present invention was used with the dimensions of the plate being sufficient to at least encompass the upper end of the pouch when the pouch is open and positioned at the purging station. In order to provide a non-turbulent, balanced flow of air and steam in all directions out of the pouch along the balanced flow path, the optimum setting was about $\frac{1}{8}$th inch above the pouch and the optimum steam pressure was within the range of about 1–2 inches of water when the pouch size was about 6½ inches times 8½ inches. It was also noted that purging with a heated product in the pouch improved the purging efficiency.

Although pouches have been illustrated and described as the containers, and saturated steam has been disclosed as the air purging neutral gas, it will be understood that the purging method and apparatus of the present invention may use other neutral gases and purge air from other types of containers. It will also be understood that the same principles apply to purging gases from other larger containers but that the valve setting and the neutral gas pressure may be increased somewhat.

From the foregoing description it is apparent that an improved and very simple air purging method and apparatus is disclosed which uses a continuous flow of a low pressure neutral purging gas that is directed into the open end of a container through a flow control valve having a flat surface encompassing the open end of a container and disposed substantially parallel to and within about ⅛th inch from the container when the container is of a size capable of packaging only about 400 grams of product.

Although the best mode contemplated for carrying out the present invention has been herein shown and described, it will be apparent that modification and variations may be made without departing from what is regarded to be the subject matter of the invention.

I claim:

1. A flow control apparatus for purging air from a product filled container when one end of the container is open, said apparatus comprising a flow control valve having an apertured flat flow control surface positioned adjacent said open end of the container to overlap the open end while being spaced about ⅛th of an inch therefrom, and means for directing a neutral air purging gas at a pressure of between about 1–2 inches of water through said aperture into the open end of the container for creating a gentle non-turbulent flow of air and other gases out of the container along an unobstructed balanced flow path defined between the periphery of the open end of the container and said flat flow control surface.

2. An apparatus according to claim 1 wherein said neutral gas is saturated steam.

3. An apparatus according to claims 1 or 2 wherein the container is disposed in the ambient atmosphere during purging.

4. An apparatus according to claims 1 or 2 and additionally comprising means for closing the container after the air purging operation has been completed and while said flat flow control surface is positioned adjacent said end of the container.

5. An apparatus according to claims 1 or 2 wherein the flat flow control surface is substantially horizontal and wherein the open end of the container is the upper end thereof.

6. An apparatus for purging air from a product filled container that is supported in the ambient atmosphere surrounding the apparatus with an end of the container defined by a peripheral edge being open and defining a headspace containing air; said purging apparatus comprising a flow control device including a plate type flow control valve having a flat surface positioned to overlap and lie closely adjacent to and substantially parallel with the plane of the peripheral edge defining the container opening, means defining a relatively large opening in said plate valve having a closed periphery smaller than and communicating with the headspace of the container, and means for continuously directing a neutral air purging gas at a low pressure through said large opening at a relatively high volume flow which flushes air as a gas from the container between said flat surface and the peripheral edge of said open end of the container in a controlled substantially non-turbulent balanced flow.

7. An apparatus according to claim 6 wherein said neutral gas is saturated steam at a pressure of about 1 inch of water.

8. An apparatus according to claims 6 or 7 and additionally comprising means for adjusting said flat flow control surface toward or away from the open end of the container to provide the least amount of turbulence to the flow of said low pressure neutral air purging gas and air out of the container between said peripheral edge and said flat surface.

9. An apparatus according to claim 6 and additionally comprising first and second pressure reducing means for providing a two-step pressure reducing system to reduce the pressure of said neutral gas to said low pressure for providing a more stable control over the flow of neutral gas with minimum fluctuations.

10. A method of purging air from containers using an apertured flow control valve having a flat surface disposed substantially parallel to the peripheral edge of the open end of the container to be purged; said method comprising the steps of establishing relative movement between the container and the flow control valve for positioning said flat flow control surface in a purging position overlapping and closely adjacent to the open end of the container, providing a neutral air purging gas at a low pressure, and directing said purging gas at said low pressure through the aperture into the open end of the container for creating a gentle substantially non-turbulent flow of air and other gases out of the container in the form of a gas and along an unobstructed balanced flow path defined between the periphery of said open end of the container and said flat flow control surface.

11. A method according to claim 10 wherein said neutral gas is steam at a pressure of about 1–2 inches of water.

12. A method according to claims 10 or 11 wherein the spacing between said flow control surface and the open end of the container is about ⅛th of an inch.

13. A method according to claims 10 or 11 including the additional step of adjusting the flow control surface toward or away from said open end for providing a spacing wherein the gases discharging along said balanced flow path provide the least amount of turbulence of gases being discharged from the container for the particular volume and pressure of neutral gas being directed into the container.

14. A method according to claim 10 and additionally comprising the step of closing the open end of the container after completion of the air purging operation and while the flat flow control surface is positioned adjacent said end of the container.

* * * * *